United States Patent [19]

Mogensen

[11] Patent Number: 4,678,021

[45] Date of Patent: Jul. 7, 1987

[54] METHOD AND AN APPARATUS FOR REPLACING PATTERN PLATES IN A MOULDING SYSTEM

[75] Inventor: Vagn Mogensen, Gentofte, Denmark

[73] Assignee: Dansk Industri Syndikat A/S, Herlev, Denmark

[21] Appl. No.: 774,410

[22] Filed: Sep. 10, 1985

[30] Foreign Application Priority Data

Sep. 10, 1984 [DK] Denmark ..... 4315/84

[51] Int. Cl.[4] ..... B22C 15/02; B22C 17/00; B22C 19/00

[52] U.S. Cl. ..... 164/40; 164/49; 164/187; 164/207; 164/213; 164/241

[58] Field of Search ..... 164/40, 44, 187, 241, 164/207, 213

[56] References Cited

U.S. PATENT DOCUMENTS

| | | | |
|---|---|---|---|
| 2,681,484 | 6/1954 | Strommen | 164/187 |
| 3,734,163 | 5/1973 | Larkin | 164/213 X |
| 3,760,866 | 9/1973 | Larkin | 164/40 X |
| 3,901,304 | 8/1975 | Jacobsen | 164/159 |
| 4,026,345 | 5/1977 | Wallwork | 164/213 X |
| 4,541,476 | 9/1985 | Larsen | 164/182 |

FOREIGN PATENT DOCUMENTS

| | | | |
|---|---|---|---|
| 69888 | 11/1969 | German Democratic Rep. | 164/40 |

*Primary Examiner*—J. Reed Batten, Jr.
*Attorney, Agent, or Firm*—Larson and Taylor

[57] ABSTRACT

A method and an apparatus for replacing pattern plates in a moulding plant for making boxless mould parts of sand or other like material is characterized by the use of a revolving table (1), which is provided with e.g. four symmetrically placed arms (1), in which are suspended pattern plates (2,3). The revolving table is designed for sequential conveying of the pattern plates (2,3) for placing these on a squeeze plate (PP) and a counter-pressure plate (MTP), respectively, in the moulding chamber of a moulding plant (suggested only on the drawing). The pattern plates (2,3) are placed in the respective arms (1) when the latter are just opposite the changing position. From the changing position, the pattern plates (2,3) are conveyed into a moulding chamber by a transverse sliding movement in an essentially known manner.

6 Claims, 2 Drawing Figures

METHOD AND AN APPARATUS FOR REPLACING PATTERN PLATES IN A MOULDING SYSTEM

Figure 1:
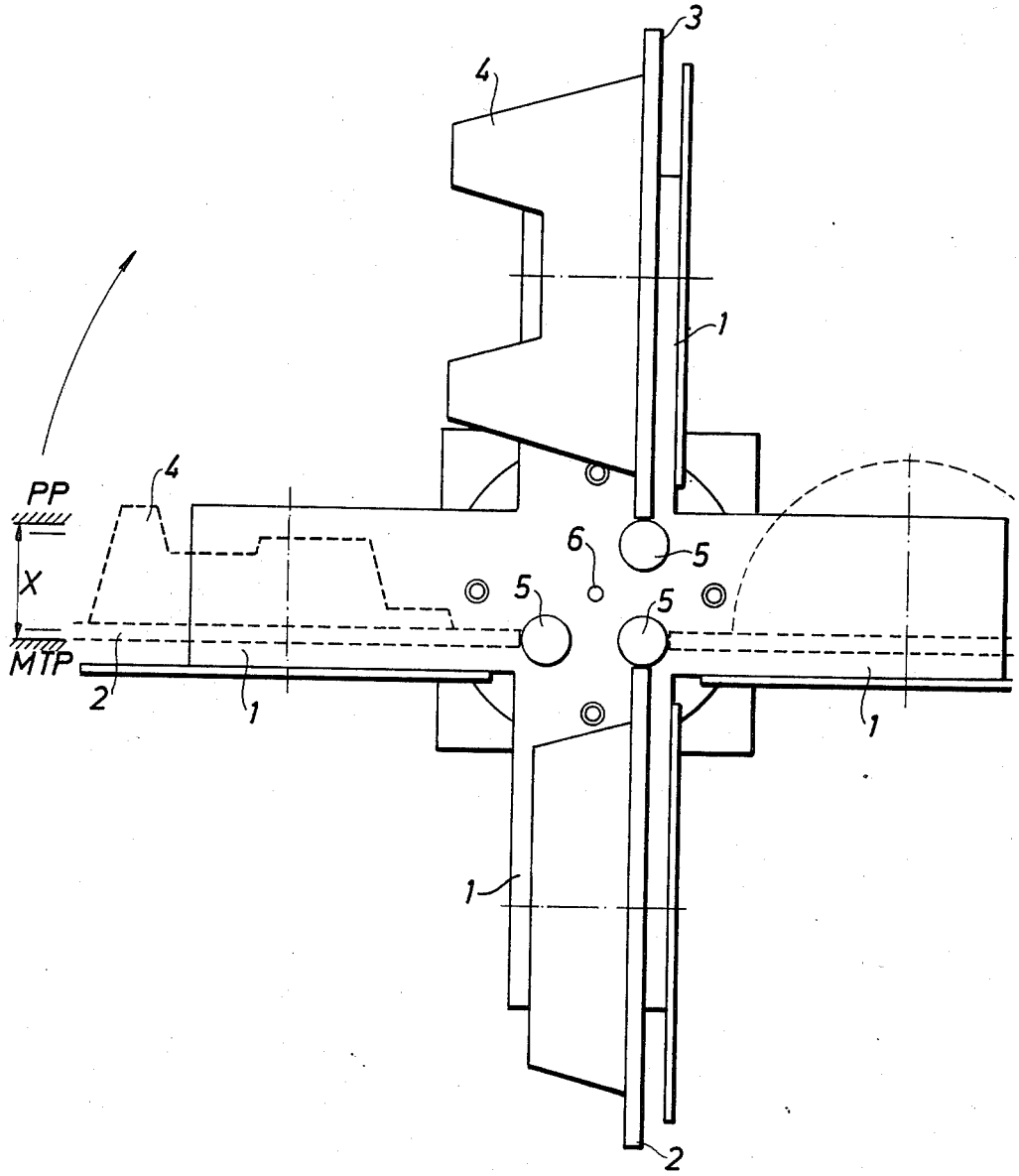

The invention relates to a method and an apparatus for replacing pattern plates in a moulding system for making boxless mould parts of sand or other like material, which are made in a moulding chamber between opposite pattern plates, which are releasably secured to pattern fixtures, and then the mould parts are conveyed forward in step with being manufactured to close up on a moulding line in order to jointly form casting moulds.

A special truck is known from the Danish Patent Specification No. 125,776 for use in changing pattern plates in moulding systems of the aforesaid type. The truck has at least one pair of transversely slideable pattern plate carriers, which can be brought to be flush with their respective squeeze plates' pattern fixtures, to which the pattern plates are locked in their position of use. After releasing the locks in question, the pattern plates can be manually pulled onto the carriers of the truck and be taken to the storage room, from where another pair of pattern plates can be brought into change position in relation to the fixtures of the squeeze plates and be transferred and locked to these.

To speed up the changing procedure, the truck might be provided with two pairs of pattern plate carriers, viz. one pair for receiving the pattern plates just used and another pair for delivering another set of pattern plates, but even in that case a certain loss of production will have to be allowed for, because normally the change procedure takes at least 3 minutes and often 6–8 minutes. Furthermore, the change procedure requires a substantial amount of manual work.

These circumstances may be endured when making long runs, which require only a few pattern plate changes in the course of one day, but with a view of reduced storage needs and the possibility of quickly taking action in the case of ascertaining casting errors, it is often desirable to operate with far more frequent changes, e.g. up to 10 changes per hour, and such a wish cannot be met in a financially defensible manner by using the aforesaid truck.

The aforesaid disadvantages with respect to the too long changing period and the heavy handling of the pattern plates have been removed by means of the assembly for automatic pattern plate change described in the previous Danish patent application No. 783/81.

The aforesaid assembly, however, is a comparatively complicated and consequently relatively expensive solution, which can normally be used only in very large moulding systems.

The object of the invention is to provide a method and an apparatus, which is both a simple and cheap solution to the problem of quick and easy pattern plate change, and at the same time so simple that it is economical both in making and in the subsequent operation and maintenance.

According to the invention, this object is achieved by a method of the type mentioned in the opening paragraph, characterized in that the pattern plates are conveyed into and out of the moulding chamber by a transverse sliding movement between a position outside the moulding chamber in which the rear of the pattern plates is essentially flush with the front of the pattern fixture, whereby the pattern plates are brought into the said flush position by turning a pattern plate carrier designed as a revolving table (turntable).

By using a revolving table to bring the pattern plates into a position outside the moulding chamber, in which they are essentially flush with the pattern fixture of the squeeze plate in question, the pattern plate change can be controlled in a very simple manner by controlling the rotating movement of the turning table, just as it will be possible to make the change of the pattern plates without interference at that portion of the turning table which is turned away from the pattern plate changing position. Of course, this initial change can be made while the moulding machine is operating and well ahead of the pattern plate change proper.

The object of the invention is moreover achieved by an apparatus which includes a carrying assembly placed outside the moulding chamber in a conventional system for making boxless mould parts for releasable fixing of pattern plates, which system includes two pattern fixtures placed opposite each other at either end of the moulding chamber, said fixtures both having well-defined positions for receiving pattern plates. The apparatus is characterized in that the carrying assembly is designed for sequential positioning of the pattern plates to positions in which their rear sides are essentially flush with one of the pattern fixtures in the pattern plate receiving position.

Designing the carrying assembly in such a way that the pattern plates can be brought to be flush with the pattern fixtures in both squeeze plates, enables very simple location of the plates, as only a rectilinear transverse sliding movement is required from the position in the revolving table outside the moulding chamber to the position in the moulding chamber in which the pattern plate is in locked engagement with the pattern fixture.

In a possible embodiment of the apparatus according to the invention, the carrying assembly is designed as a revolving table or a turntable wit arms running radially in relation to the axis of rotation of the revolving table, said arms being designed to support the pattern plates and guide them during the initial/concluding transverse shifting towards/away from the pattern fixture.

Due to the radially protruding arms, there will be plenty of space to make the initial change of the pattern plates over a very great section of the circumference of the revolving table.

According to the invention, the arms can be designed to support the pattern plates in such a way that the rear of the plates intended for engagement with the pattern fixture is at a plane that runs parallel to and at a distance from a plane through the axis of rotation of the revolving table.

By this measure, a very convenient and simple possibility is achieved for distinguishing between pattern plates to be placed on the respective squeeze plates, as the pattern plates located in the moulding chamber opposite each other are usually different. At the same time, this "shifted" way of location compensates for the distance between the squeeze plates in their changing position.

In an apparatus according to the invention, where the moulding system is a moulding machine for making mould parts with a vertical parting line, the axis of rotation of the revolving table is vertical.

In this way, it is possible to place the mould parts in the arms of the revolving table in the position in which they are later to be secured to the mould fixture, which seems logical and consequently favours easy operation.

Correspondingly, in an apparatus according to the invention, where the moulding system is a moulding machine for making mould parts with a horizontal parting line, it would be expedient to let the axis of rotation of the revolving table run horizontally.

In an embodiment of an apparatus according to the invention preferred in practice, the axis of the revolving table is stationary in relation to the frame of the moulding system.

In this way it is possible to build together the supporting unit with the moulding plant, and thus possibly keep the floor area at the moulding system free.

According to the invention, the pattern plates can at their top be provided with carrying rollers, designed to run in a guide path in the arms of the carrying assembly, whereby a roller path for the transverse sliding movement of the pattern plates is formed jointly with a guide path opposite the pattern fixture.

In this way, a simple and secure conveying of the pattern plates is achieved; the said pattern plates may be designed as standard units that do not require special brackets or rails, as the elements that are already necessary for the transverse movement in the moulding chamber proper can also be used to support and control the movement in the carrying assembly.

In a preferred embodiment, the transverse forward and backward movement of the pattern plates is achieved by means of a stationary working cylinder.

In this way, simple automation of the transverse movement is achieved.

According to the invention, the sequential rotation of the pattern plates by the carrying assembly can be achieved by means of one single driving unit.

The use of only one single driving assembly also permits simple control and automation of the change of pattern plates.

Figure 2:
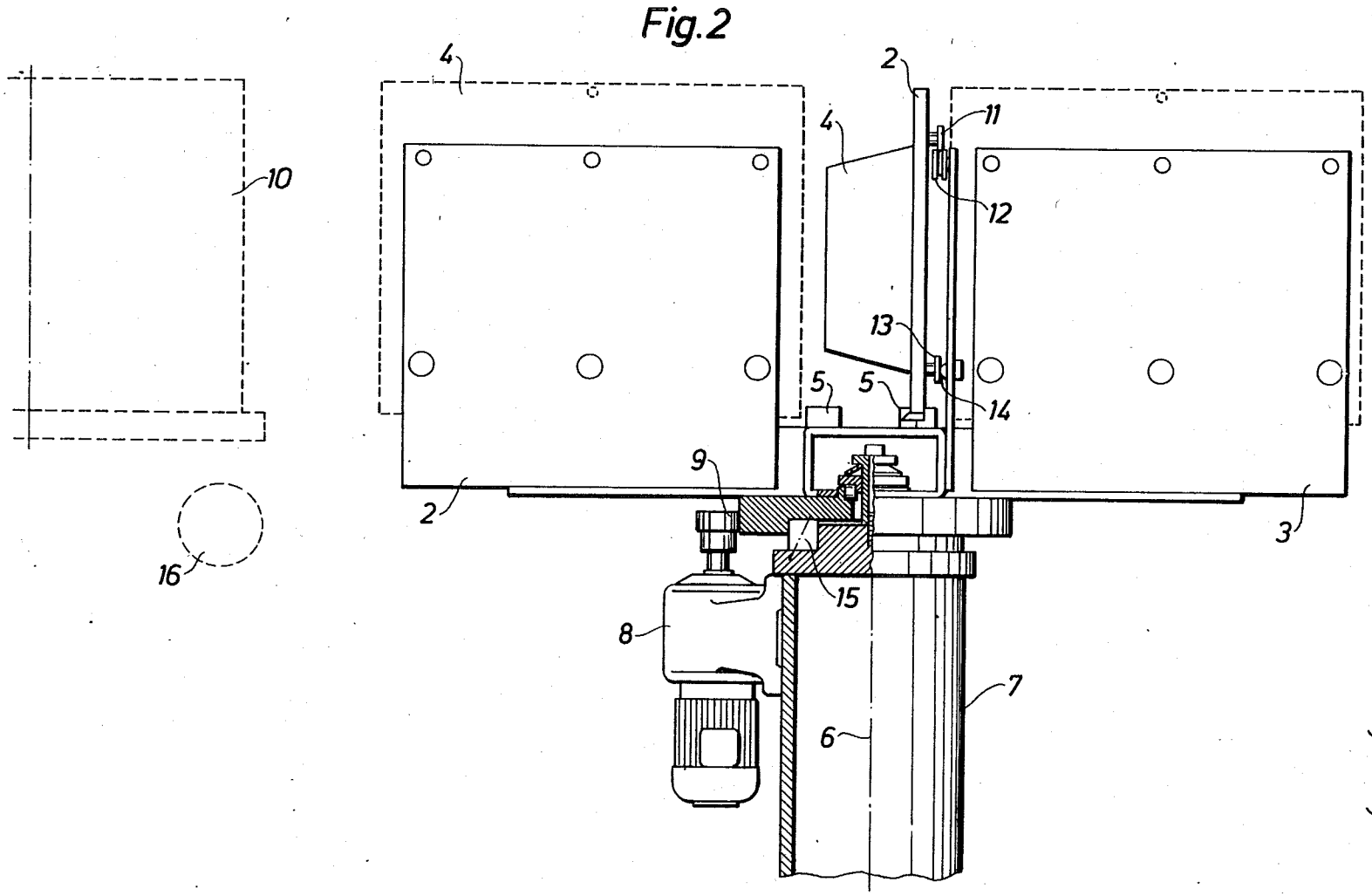

The invention will be explained in more detail below with reference to the drawing, in which FIG. 1 shows an assembly designed according to the invention, viewed from above, and FIG. 2 is a side and partial sectional view of the same.

FIG. 1 shows a possible embodiment of an assembly according to the invention. The apparatus incorporates four radially protruding arms 1, designed to rotate around an axis of rotation 6. The arms 1 are designed to support the pattern plates 2,3 bearing patterns 4 in such a way that the rear of the pattern plates 2, which are designed for being placed on or removed from e.g. the counter-pressure plate (MTP) of the moulding machine, are placed flush with the pattern fixture of the counter-pressure plate when the arm is opposite the moulding chamber. Correspondingly, the pattern plates to be placed on the squeeze plate (PP) are placed with their rear side flush with the pattern fixture of the squeeze plate when the arm in question is opposite the moulding chamber.

The arms are designed to rotate in the direction indicated by the arrow in FIG. 1.

In a conventional moulding machine, both the counter-pressure plate and the squeeze plate have well-defined pattern change positions. These positions are indicated to the left in FIG. 1. The squeeze plate and the counter-pressure plate are not in the pattern plate change position at the same time, and the indicated position is therefore very schematic and only intended to show that the pattern change position of the two plates is not the same.

The distance between the pattern change position of the squeeze plate and the counter-pressure plate is approximately indicated by the letter X in FIG. 1. The distance between the rear of pattern plates 2 and 3, respectively, when placed in their respective change positions opposite the moulding chamber, corresponds exactly to the said distance X. The distance X is merely shown as a relative indication of the different locations of the squeeze plate and the counter-pressure plate when they assume their respective pattern change positions.

The sliding movement of the pattern plates 2,3 on the arms 1 is limited by elastic end stops 5 at the one end.

FIG. 2 shows an apparatus according to the invention seen from the slide and partially in section. The unit is built around a stationary column 7, whose center axis defines the axis of rotation 6 for the arms 1. In the shown embodiment, the arms are designed as a cross-shaped element of a hollow profile, to which upward protruding plates are secured, at the top supporting carrying rollers 12 and at the bottom guide balls 14, designed to cooperate with a supporting rail 11 at the top of the rear of the pattern plate 2 and a supporting rail 13 at the lower portion of the pattern plate, respectively. The pattern plate 2 shown to the left in FIG. 2 can be slid in the plane of the paper to the left toward the pattern fixture 10, placed in the moulding chamber of a moulding machine (not shown), but where feeding of one of the squeeze pistons is suggested by the reference number 16. In the moulding chamber, carrying rollers (not shown) are procured, said carrying rollers corresponding to carrying rollers 12 and having the same function as these, as they are designed to receive and guide the pattern plate 2 by engagement with the carrying rail 11.

FIG. 2 shows a driving assembly consisting of a motor 8 and a friction roller 9, which cooperates with a disc under the arms designed as a cross. The disc is designed to turn via an axial bearing 15.

For controlling the sequential feeding of the arms 1, a pawl mechanism is provided (not shown). The pattern plates are usually placed manually in the arms turned away from the changing position, whereas the turning of the arms can be made either manually or controlled, optionally as an element in high-level computer-based control of the entire mould part making.

In the embodiment shown in the drawing, four arms are used, but it is of course within the scope of the invention to use a random number of arms, which are preferably placed at an equidistance of an angular arc around the axis of rotation 6 in order to avoid weight balancing problems.

I claim:

1. A method of changing pattern plates in moulding apparatus, said moulding apparatus comprising:

a moulding chamber;

pattern fixtures in said moulding chamber for moulding an article between opposed front faces of said pattern fixtures;

means for releasably securing a pattern plate to respective opposed front faces of said pattern fixtures;

means for conveying pattern plates to said pattern fixtures by a transverse sliding movement between a first position outside said moulding chamber in which first position the rear of the pattern plate is essentially flush with the front of respective pattern fixture and a second position in said moulding chamber in which second position the rear surface of a pattern plate is adjacent the front face of a respective pattern fixture;

said method comprising providing a rotatable member comprising means for holding said pattern plates on said rotatable member such that the rear surface thereof extends in a plane substantially parallel to a plane which includes the axis of rotation of said rotatable member and which is spaced a distance from said plane; and rotating said rotatable member to bring each respective pattern plate into said first position.

2. Moulding apparatus comprising:

a moulding chamber;

pattern fixtures in said moulding chamber for moulding an article between opposed front faces of said pattern fixtures;

means for releasably securing a pattern plate to respective opposed front faces of said pattern means for conveying pattern plates to said pattern fixtures; fixtures by a transverse sliding movement between a first position outside said moulding chamber in which first position the rear of a pattern plate is essentially flush with the front of a respective pattern fixture and a second position in said moulding chamber in which second position the rear surface of a pattern plate is adjacent the front face of a respective pattern fixture; and means for changing pattern plates in said moulding apparatus comprising:

a rotatable member;

means for holding said pattern plates on said rotatable member such that the rear surface thereof extends in a plane substantially parallel to a plane which includes the axis of rotaton of said rotatable member and which is spaced a distance from said plane; and means for rotating said rotatable member to bring each respective pattern plate into said first position.

3. Apparatus according to claim 2 further comprising frame means for supporting said molding apparatus and wherein said rotatable member is mounted for rotation of said frame means such that its axis of rotation is fixed with respect to said frame means.

4. Apparatus according to claim 2 wherein said pattern fixtures comprise a first texture for releasably securing a squeeze pattern plate and a second fixture for releasably securing a counter-pressure pattern plate with its front face opposed and substantially parallel to the front face of a squeeze pattern plate and wherein said rotatable member comprises first and second radial arms, said first radial arm comprising means for holding a counter-pressure pattern plate having a substantially planar rear surface such that said rear surface extends in a plane substantially parallel to a plane which includes the axis of rotation of said rotatable member and spaced a distance from said plane, said second radial arm comprising means for holding a squeeze pattern plate having a substantially planar rear surface such that said rear surface extends in a plane substantially parallel to a plane which includes the axis of rotation of said rotatable member and spaced a distance from said plane in a direction substantially opposite to the direction in which the rear surface of said counter-pressure pattern plate is spaced from said plane.

5. Apparatus according to claim 4 wherein the axis of rotation of said rotatable member is substantially vertical.

6. Apparatus according to claim 4, wherein the axis of rotation of said rotatable member is substantially horizontal.

* * * * *